United States Patent [19]

Ko

[11] Patent Number: 4,624,384

[45] Date of Patent: Nov. 25, 1986

[54] LID FOR DRINKING CONTAINERS

[76] Inventor: Duk H. Ko, 12354 Runnymede, Ste. #2, N. Hollywood, Calif. 91605

[21] Appl. No.: 751,440

[22] Filed: Jul. 3, 1985

[51] Int. Cl.[4] ..... B65D 41/26; B65D 51/24

[52] U.S. Cl. ..... 220/212; 220/90.4; 220/306; 222/173; 248/312; 248/312.1

[58] Field of Search ..... 220/90.2, 90.4, 306, 220/90.6, 212; 222/173; D7/9, 10, 70; 211/71; 248/312, 312.1

[56] References Cited

U.S. PATENT DOCUMENTS

| | | | |
|---|---|---|---|
| D. 158,187 | 4/1950 | Geerlings | D7/10 |
| D. 220,462 | 4/1971 | De Van et al. | D7/70 X |
| 933,881 | 9/1909 | Brown | 222/173 |
| 2,600,839 | 6/1952 | Brown | 222/173 |
| 2,839,229 | 6/1958 | Scheswohl | 220/90.4 X |
| 3,185,341 | 5/1965 | Barbour | 220/306 X |
| 3,286,969 | 11/1966 | Frescobaldi | D7/70 X |
| 3,372,832 | 3/1968 | Yeater et al. | 220/90.4 X |
| 3,516,572 | 6/1970 | Davis | 220/306 |
| 3,883,036 | 5/1975 | Mahaffy et al. | 220/306 |
| 4,003,503 | 1/1977 | Aldridge | 222/173 |
| 4,055,273 | 10/1977 | Jones | 220/90.4 X |
| 4,098,439 | 7/1978 | Blow, Jr. et al. | 220/90.6 X |
| 4,099,642 | 7/1978 | Nergard | 220/90.4 |
| 4,415,097 | 11/1983 | Meins | 220/90.4 |

*Primary Examiner*—Allan N. Shoap
*Attorney, Agent, or Firm*—Frank Frisenda, Jr.

[57] ABSTRACT

An improved resilient end closure for a beverage container having a generally cylindrical side wall is provided by the present invention. The unique end closure comprises in one embodied form, a stabilizer disposed on a peripheral portion of the closure to limit axial movement of the beverage container when the container is oriented on a side wall; a groove disposed on the underside of the periphery of the end closure, the groove being configured to provide a snap fit with and detachably secure the closure to the top portion of the beverage container; and a through port disposed on the closure adjacent the circumferential edge of the closure sustantially opposite the peripheral portion of the closure having the stabilizer. In a preferred embodiment of the present invention, the improved resilient end closure further comprises an elongated stepped skirt portion about the circumference of the closure for insuring mating of the end closure with conventional beverage containers having a preformed lip in an upper portion of the container. Preferably, the through port disposed in the end closure has a substantially elliptical opening to facilitate drinking directly from the container and to facilitate easy insertion of for instance, a beverage straw into the container.

2 Claims, 4 Drawing Figures

LID FOR DRINKING CONTAINERS

BACKGROUND OF THE INVENTION

This invention relates to beverage containers and particularly, to horizontal wall members such as lids which integrate with the top portion of the container to provide a detachable closure therefore.

Beverage containers for sodas, juices, fruit drinks, etc., of the type having an inwardly tapered wall at a lower end portion are well known to the beverage industry. Generally, these containers have been constructed from styrofoam plastic which provides disposability of the container after use, and maintains the desired temperature of both hot and cold beverages.

A number of skilled artisans have sought to improve lid closures for such containers, for instance by incorporating through ports into the closure which allow a person to drink directly from a covered container without having to remove the lid. Such improved closures desirably prevent accidental spillage or sloshing out of the container contents, while at the same time preventing contamination of the beverage in the container, for instance, caused by dust, sand, etc.

One such beverage container lid is disclosed in U.S. Pat. No. 4,187,954, issued to Striggow on Feb. 12, 1980. The Striggow invention provides a lid for a beverage container which makes possible emptying the contents of the container without removing the lid through a small opening formed in the lid and separated therefrom by a line of weakening. The cover member comprises an elevated spout member and can be removed by distorting the cover member with either the fingers or the teeth to rupture the line of weakening for removal of the cover.

Yamazaki, in U.S. Pat. No. 4,113,135, issued Sept. 12, 1978, discloses a drinking cup cover which includes a self-closing opening therethrough so that the lid can be retained upon the cup while drinking from the cup. The opening is closeable by a flap that is pushed into the open position by pressure from a persons lip whenever placed against the flap.

In U.S. Pat. No. 3,952,910, Wheeler discloses a self-sealing container closure that prevents spillage and that simultaneously permits drinking from the container or cup, without the removal of the closure. The Wheeler closure comprises a generally resilient central face having an aperture therethrough defined by overlapping edges, and a skirt extending from the periphery of the central face, having an integral engaging means formed as the inner face of the skirt for seating engagement with a rim portion of the container.

In U.S. Pat. No. 4,350,260, Prueher discloses a lid for drinking containers comprising a mouth piece having a valve at its base, operated by the drinker's lips, by the application of pressure on a portion of the lid. The mouthpiece, with valve on the lid, prevents spilling of the liquid, if the container is accidentally dropped, precludes spilling of the liquid during the time the drinker is engaged in drinking the liquid from the container, even when the drinking is done under adverse conditions, and provides facilitated means for adding condiments to hot beverages for consumption by a user.

Other patents pertinent to the field of this invention include U.S. Pat. Nos. 4,345,695; 4,113,135; 4,412,629; 4,428,498; and 4,438,865. Each of these patents include improved lids for drinking containers and demonstrate the constant ongoing improvements in the art related to beverage containers and end closures therefore.

A substantial number of conventional styrofoam beverage containers include an inwardly tapered side wall at the lower closed end of the container. Such tapering provides for easy stacking of the beverage container while not in use, and for instance, maintained as inventory by a store merchant. The tapered configuration of these containers, however, possesses the disadvantage of inherent instability, particularly, if the container is relatively large (16 fluid ounces or more) and is relatively full with a beverage. The degree of tapering, materials of construction, and amounts of fluid, as well as overall configuration of the container, of course are factors affecting the center of gravity of a filled container, which ultimately affects its stability.

When such beverage containers are oriented on its lower end wall, it is not uncommon for a filled container to accidentally tip over and spill the beverage from the container, for instance, by an inadvertent bump or knock. Such accidental spillage or sloshing out of the contents is particularly likely if the user is drinking from the container in, for instance, an automobile vehicle.

Those skilled in the art, have therefore recognized a significant need for an improved end closure for a beverage container which minimizes the occurrence of accidental spillage or sloshing out of contents of the beverage container, particularly, for use in users drinking tea or coffee in an automobile vehicle. Further, such artisans have recognized a need for an improved end closure having an integral through port disposed in a portion of the container, which permits the user to sip or drink beverages from the container without having to remove the end closure. The present invention fulfills these needs.

SUMMARY OF THE INVENTION

The present invention provides an improved resilient end closure for a beverage container having a generally cylindrical side wall.

In a presently preferred embodiment, the unique end closure comprises stabilizer means disposed on a peripheral portion of the closure to limit axial movement of the beverage container when the container is oriented on a side wall; a groove disposed on the underside of the periphery of the enclosure, the groove being configured to provide a snap fit with and detachably secure the closure to the rim of the beverage container; and a through port disposed on the closure adjacent the circumferential edge of the closure substantially opposite the peripheral portion of the closure having the stabilizer means.

In one preferred embodiment of the present invention, the improved resilient end closure further comprises an elongated step skirt portion about the circumference of the closure for insuring mating of the end closure with a wide variety of conventional beverage containers having preformed lips in an upper portion of the container, generally near the rim.

Preferably, the through port disposed in the inventive end closure has a substantially elliptical opening to facilitate drinking directly from the container and to facilitate easy insertion of, for instance, a beverage straw into the container.

Accordingly, the present invention provides an improved lid for a beverage container which prevents accidental spillage or sloshing out of the container contents, while at the same time preventing contamination of the container contents, for instance, by dust or other particulate material. Perhaps, more importantly, the improved end closure permits the covered beverage container to be oriented on its side wall, thus giving the covered container improved stability when used, for instance, in an automobile vehicle.

The above and other features of the invention will become more readily apparent from the following detailed description taken in conjunction with the accompanying drawing and claims.

DESCRIPTION OF THE PREFERRED EMBODIMENT

The present invention provides an improved resilient end closure for a beverage container having a generally cylindrical side wall.

The unique end closure comprises in one embodied form, a stabilizing means disposed on a peripheral portion of the closure to limit axial movement of the beverage container when the container is oriented on a side wall. A groove is disposed on the underside of the periphery of the enclosure and is configured to provide a snap fit with and detachably secure the closure to the upper rim portion of the beverage container. The inventive end closure further comprises a through port which is disposed on the end closure adjacent the circumferential edge of the closure substantially opposite the peripheral portion of the closure having the stabilizer means.

Figure 1:
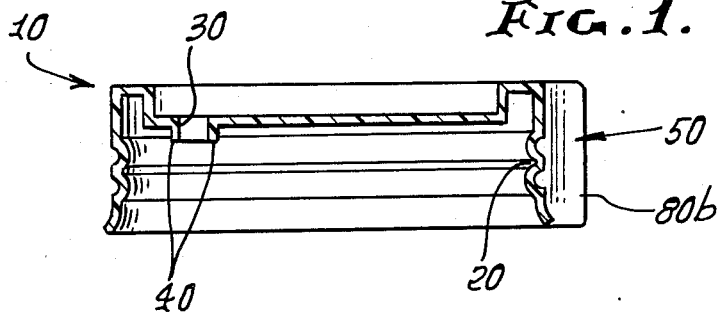
FIG. 1 is a cross-sectional side view of the Improved Lid for Beverage Container, in accordance with one embodied form of the invention.
Figure 2:
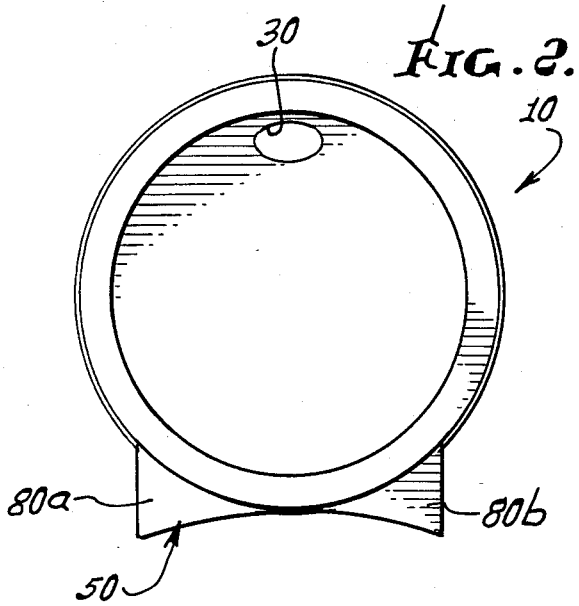
FIG. 2 is a top, elevational view of the Improved Lid for Beverage Container shown in FIG. 1, and depicts stabilizer means provided on a lower peripheral portion of the lid in accordance with one embodied form of the invention.
Figure 3:
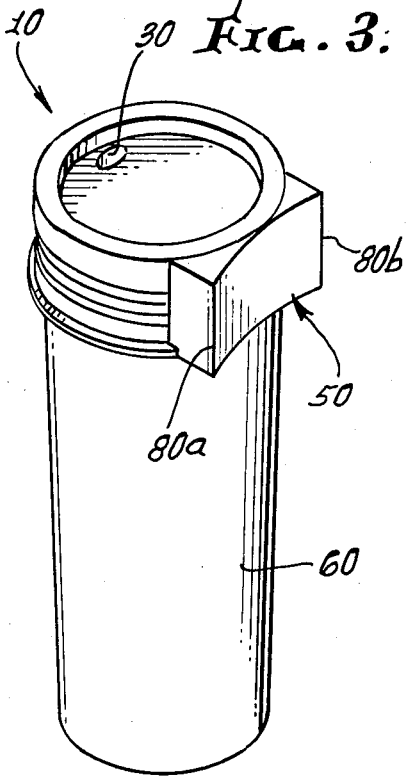
FIG. 3 is a perspective view of a conventional styrofoam container having an improved resilient end closure provided thereon in accordance with one embodiment of the present invention.

Referring now to the drawings, FIGS. 1 and 2 depict one embodied form of the improved resilient end closure 10 in accordance with the present invention. The end closure 10 may generally be described as a disc shape horizontal wall member typically constructed of resilient plastic.

The closure 10 includes a groove 20 disposed on the underside of the periphery of the end closure. The groove 20 is configured to provide a snap fit with and to detachably secure the underside of the closure with the upper rim portion of the beverage container to be covered.

As seen most clearly in FIGS. 1 and 2, the inventive end closure 10 includes a through port 30 disposed adjacent the circumferential edge of the horizontal end wall of the closure 10. Preferably, the through port 30 is a substantially elliptical opening provided in the closure 10. This configuration facilitates sipping of the contents of the container through the end closure 10. Preferably, the through port 30 includes dampening members 40 at the lower portion of the through port 30. The dampening walls 40 thereby minimize sloshing of the beverage from the through port, for instance, as a covered beverage is carried by a user. Further, the internal side walls 40 of the through port facilitate the direct passage of beverage flowing from the through port.

Figure 4:
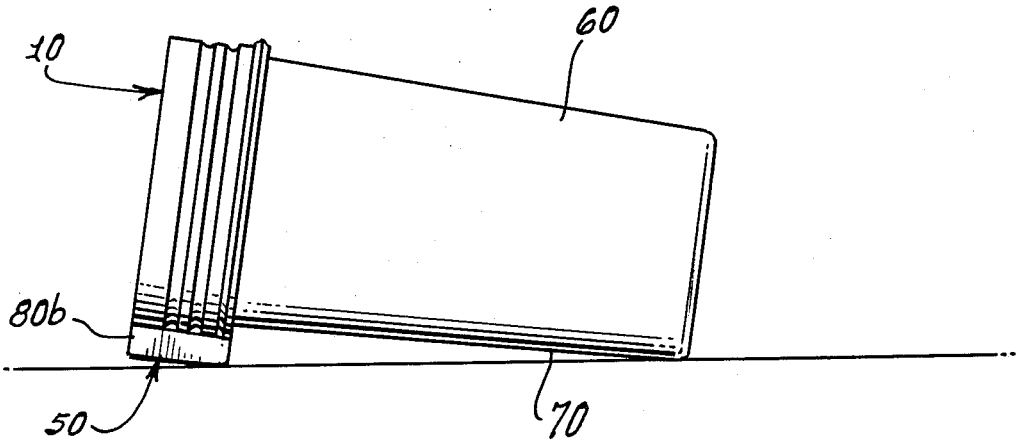
FIG. 4 is a side elevational view of a covered beverage container in accordance with the present invention, oriented on its side wall.

The inventive end closure in accordance with a preferred embodiment of the present invention comprises stabilizer means 50 disposed on a peripheral portion of the closure 10 for limiting axial movement of the beverage container 60 when the beverage container is oriented on its side wall 70 as shown in FIG. 4. The stabilizer means 50 may generally be described as a pair of feet 80*a* and 80*b*, projecting radially from the circumference of the end closure 10. The configuration of the feet 80 may vary from that specific shape shown in FIG. 2, but will be configured to produce a substantially flat projection upon which the beverage container will rest when the covered beverage container is oriented on its side wall.

The stabilizer means 50 enables the user of a filled beverage cup to orient a filled and covered beverage container on its side wall, for instance, upon the dashboard of a motor vehicle and to periodically sip a beverage from the through port. The filled beverage container will therefore be less prone to tipping over and spilling its contents in that the improved beverage container resting on its side has a lower center of gravity than a filled beverage container oriented with its lower end ball resting on a surface.

A substantial number of conventional styrofoam beverage containers include an inwardly tapered side wall at the lower closed end of the container. Such tapering provides for easy stacking of the beverage container while not in use, and for instance, maintained as inventory by a store merchant. The tapered configurations of these containers, however, possesses the disadvantage of inherent instability, particularly, if the container is relatively large (16 fluid ounces or more), and is relatively full with a beverage. The degree of tapering, materials of construction, and amounts of fluid contained within the beverage container, as well as the overall configuration of the container, of course are factors affecting the center of gravity of a filled container, which ultimately affects its stability.

The improved beverage container in accordance with the present invention therefore provides a covered container which minimizes the occurrence of accidental spillage or sloshing of the contents out of the beverage container. Further, the improved end closure with integral through ports permits the user to sip or drink beverages from the container without having to remove end closure.

Those skilled in the art will readily appreciate that the above-described features can be widely varied in configuration, materials, etc., and it is not intended that the invention be limited, but rather, will encompass various modifications and variations therein without departing from the spirit and scope of the invention claimed.

I claim:

1. An improved resilient end closure having a generally circular cross-section for securing to the top of a beverage container having a generally cylindrical side wall, said resilient end closure comprising:

an elongated stepped skirt portion about the circumference of said end closure for insuring mating of said end closure with an upper portion of the beverage container;

stabilizer means disposed on a peripheral portion of said stepped skirt of said end closure to limit rotational movement of said beverage container when said container is in a resting position resting on a portion of the side wall with the end closure secured to the top of the container; said stabilizer means having a radially facing and axially extending outer surface bordered at each side thereof by a side surface, the intersection of said outer surface with said side surface defining foot portions on which the container and closure are also supported along with the associated portion of the side wall in said resting position;

a groove disposed on the underside of the periphery of said end closure, said groove being configured to provide a snap fit with and detachably secure said end closure to the upper portion of the beverage container; and a fluid passageway disposed on a peripheral portion of said end closure adjacent the circumferential edge of said end closure radially inwardly of said groove substantially diametrically opposite the peripheral portion of said end closure comprising said stabilizer means.

2. The improved resilient end closure as defined in claim 1 wherein said through port disposed on said end closure is a substantially elliptical opening to facilitate drinking of beverages directly from said container and to facilitate easy insertion of a beverage straw into the container.

* * * * *